US005988628A

United States Patent [19]

Mori

[11] Patent Number: 5,988,628

[45] Date of Patent: Nov. 23, 1999

[54] SHEET SUPPLYING APPARATUS

[75] Inventor: Akihito Mori, Shizuoka-ken, Japan

[73] Assignee: Canon Kabushiki Kaisha, Tokyo, Japan

[21] Appl. No.: 08/922,532

[22] Filed: Sep. 3, 1997

[30] Foreign Application Priority Data

Sep. 6, 1996 [JP] Japan ..... 8-236566

[51] Int. Cl.[6] ..... B65H 3/06

[52] U.S. Cl. ..... 271/117; 271/118

[58] Field of Search ..... 271/117, 10.03, 271/110, 118, 126, 154

[56] References Cited

U.S. PATENT DOCUMENTS 4,077,620 3/1978 Frank et al. ..... 271/10.03
5,342,037 8/1994 Martin ..... 271/126 X
5,346,199 9/1994 Martin et al. ..... 271/126 X
5,474,288 12/1995 Lo et al. ..... 271/118 X
5,624,109 4/1997 Tanaka ..... 271/118 X
5,775,823 7/1998 Bekki et al. ..... 271/118 X

*Primary Examiner*—William E. Terrell
*Assistant Examiner*—Gene O. Crawford
*Attorney, Agent, or Firm*—Fitzpatrick, Cella, Harper & Scinto

[57] ABSTRACT

When a pick-up roller is lowered to contact with a sheet, a control means stops a tray drive motor to prohibit a lifting movement of a sheet stacking tray to thereby minimize bounding of the pick-up roller when the pick-up roller abuts against the sheet and preventing delay in sheet supply and occurrence of sheet jam.

8 Claims, 5 Drawing Sheets

SHEET SUPPLYING APPARATUS

BACKGROUND OF THE INVENTION

1. Field of the Invention

The present invention relates to a sheet supplying apparatus used with an image forming apparatus such as a copying machine, a printer, a facsimile and the like and an automatic original feeding apparatus.

2. Related Background Art

Among sheet supplying apparatus for supplying a recording sheet or an original (referred to as generically "sheet" hereinafter) in an image forming portion or an image reading portion of an image forming apparatus, there is a sheet supplying apparatus having a sheet stacking tray on which sheets are stacked and which can be lifted and lowered. In such sheet supplying apparatuses having the sheet stacking tray, a fundamental construction of a so-called sheet supply deck for containing a large number of sheets and for supplying the sheet to an image forming portion will be briefly described hereinbelow.

The sheet stacking tray can be lifted and lowered by a drive source such as a motor. After the sheets are stacked on the tray at a lowered position, the tray is lifted upon closing a cover. When a sheet surface detection sensor is contacted with an uppermost sheet to be turned ON, the drive source is stopped to stop the lifting movement of the sheet stacking tray.

The sheets stacked on the sheet stacking tray are successively supplied from an uppermost one by a pick-up roller to an image forming portion. After the sheets stacked on the sheet stacking tray are successively supplied, when the position of the upper surface of the sheet stack is lowered to disengage from the sheet surface detection sensor, the sensor is turned OFF to lift the sheet stacking tray again until the sheet surface detection sensor is turned ON. In this way, the upper surface of the sheet stack on the sheet stacking tray is maintained at a sheet supplying position having a certain level range.

The pick-up roller for supplying the uppermost sheet from the sheet stack on the sheet stacking tray is lifted when a pick-up solenoid is turned ON and is lowered by its own weight to be contacted with the upper surface of the sheet stack on the sheet stacking tray when the pick-up solenoid is turned OFF. The pick-up roller is lowered at a predetermined sheet supplying timing in response to a sheet supply signal regardless of the lifting movement of the sheet stacking tray to be contacted with the uppermost sheet in the sheet stack. When the pick-up roller is rotated, the uppermost sheet is fed out.

However, the above-mentioned conventional sheet supplying apparatus in which the sheet is fed out by the pick-up roller which can be lifted and lowered has the following drawbacks.

After the sheet surface detection sensor is turned OFF due to the reduction in height of the sheet stack on the sheet stacking tray, while the sheet stacking tray is lifted, when the pick-up roller is lowered to feed out the sheet in response to the sheet supply signal, the lowering pick-up roller strikes against the uppermost sheet in the sheet stack rested on the lifting sheet stacking tray to be bounded more greatly than the case where the sheet stacking tray is stopped, thereby arising the following problems.

Firstly, if the rotating pick-up roller strikes against the uppermost sheet in the sheet stack rested on the lifting sheet stacking tray, the surface of the sheet and/or the outer peripheral surface of the pick-up roller is rubbed and/or contaminated. If the peripheral surface of the pick-up roller is rubbed, the service life of the apparatus is worsened. If the sheet is rubbed, when the sheet is a recording sheet, quality of a transferred image is worsened, while when the sheet is an original, the original is greatly damaged.

If the pick-up roller is bounded on the sheet stack, a sheet supplying timing is delayed, so that the sheet does not reach a predetermined position within a predetermined time period. Thus, delay sheet jam frequently occurs. Further, due to the bounding of the pick-up roller, the sheet is skew-fed, that is the sheet is not separated correctly at a separation portion to cause the poor sheet separation or the sheet jam due to the skew-feed of the sheet.

Particularly, in recent image forming apparatuses and automatic original feeding apparatuses, since the sheet is conveyed at higher speed to decrease a sheet interval in the continuous sheet supply, the sheet supplying timing is hastened to frequently generate the lifting movement of the sheet stacking tray and the lowering movement of the pick-up roller simultaneously. Thus, the above problems caused by the bounding of the pick-up roller is apt to arise.

SUMMARY OF THE INVENTION

The present invention aims to eliminate the abovementioned conventional drawbacks, and has an object to provide a sheet supplying apparatus in which the bounding of a pick-up roller on a sheet stack is reduced to reduce the damage of the pick-up roller and the sheet, to thereby reduce the occurrence of sheet jam.

For realizing the above object, the sheet supplying apparatus comprises a sheet stacking means which can be lifted and lowered with stacking sheets thereon; a first drive means for lifting and lowering the sheet stacking means so that an uppermost surface of the sheets stacked on the sheet stacking means is maintained at a predetermined position; a pick-up rotary member which can be lifted and lowered, the pick-up rotary member when lowered contacting with the uppermost surface of the sheets stacked on the sheet stacking means to feed out it; a second drive means for lifting and lowering the pick-up rotary member; and a control means for controlling the first and second drive means so that the pick-up rotary member is lowered to contact the sheet when the sheet stacking means is stopped.

Also, the control means prohibits an operation of the first drive means when a sheet supply timing signal is inputted. The second drive means includes a pulse motor, and the control means prohibits an operation of the first drive means when the number of pulses is smaller than the number of pulses required for driving the pulse motor to lower the pick-up rotary member so that the pick-up rotary member contacts with the sheet are counted. The control means prohibits an operation of the first drive means when the pick-up rotary member is lowered by the second drive means, and permits the operation of the first drive means when the pick-up rotary member is lifted.

The sheet supplying apparatus, further comprises a separation means for separating the sheets supplied by the pick-up rotary member one by one, and a post-separation sensor disposed downstream of the separation means, wherein the second drive means is driven on the basis of detection of the post-separation sensor to lift the pick-up rotary member.

It further comprises a sheet surface detection sensor capable of detecting the uppermost surface of the sheets stacked on the sheet stacking means, wherein the first drive means is driven on the basis of detection of the sheet surface detection sensor to maintain the uppermost surface of the sheets stacked on the sheet stacking means in a predetermined level.

DETAILED DESCRIPTION OF THE PREFERRED EMBODIMENTS

Figure 1:
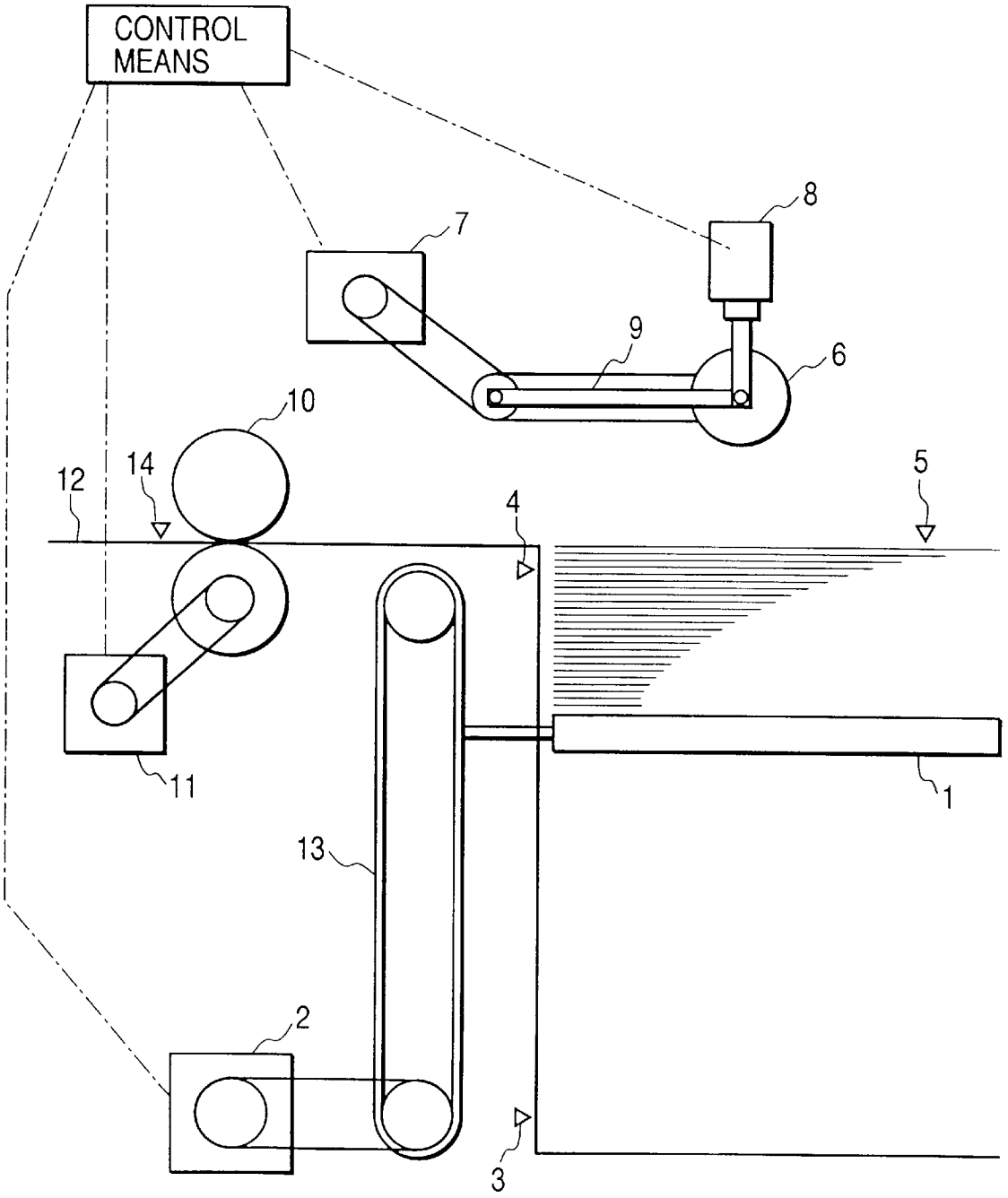
FIG. 1 is an elevational sectional view of a sheet supplying apparatus according to a first embodiment of the present invention.

The present invention will now be explained in connection with embodiments thereof with reference to the accompanying drawings. FIG. 1 shows an embodiment of a sheet supplying apparatus according to the present invention used with an image forming apparatus.

The sheet supplying apparatus includes a sheet stacking tray 1 on which sheets (recording sheets) to which images are transferred are stacked and which is supported for vertical movement, a tray drive motor (first drive means) 2 for lifting and lowering the sheet stacking tray 1, a lower limit detection sensor 3 for detecting a lower limit of the sheet stacking tray 1, an upper limit detection sensor 4 for detecting an upper limit of the sheet stacking tray 1, and a sheet surface detection sensor 5 capable of contacting an upper surface of the sheet stack resting on the sheet stacking tray 1 to detect an uppermost sheet in the sheet stack. The sheet stacking tray 1 is lifted and lowered through a transmission belt 13 for transmitting a driving force from the tray drive motor 2 to the tray.

The lifting and lowering movement of the sheet stacking tray 1 will be described. When a cover (not shown) is opened to replenish new sheets, the sheet stacking tray 1 is lowered by the tray drive motor 2 until it is detected by the lower limit detection sensor 3, regardless of the presence/absence of the sheet on the tray. After the sheets are replenished, when the cover is closed, the sheet stacking tray 1 is lifted by the tray drive motor 2. In this case, when the upper surface of the sheet stack on the tray is detected by the sheet surface detection sensor 5 or when the sheet stacking tray 1 is detected by the upper limit detection sensor 4, the tray drive motor 2 is stopped to stop the lifting movement of the sheet stacking tray 1.

Positions of the sensors 4 and 5 are so selected that, when the sheets are stacked on the sheet stacking tray 1, the sheet stack resting on the sheet stacking tray 1 is detected by the sheet surface detection sensor 5 before the sheet stacking tray 1 is detected by the upper limit detection sensor 4. Thus, if the sheet stacking tray 1 is detected by the upper limit detection sensor 4 before the sheet stack rested on the sheet stacking tray 1 is detected by the sheet surface detection sensor 5, it is judged as a sheet absence condition to cause an operation portion of the image forming apparatus to display "sheet absent".

After the sheets stacked on the sheet stacking tray 1 are successively fed out by a pick-up roller 6 (described later), when the height of the sheet stack is decreased to disengage the sheet stack from the sheet surface detection sensor 5, the sheet stacking plate 1 is lifted again by the tray drive motor 2 until the sheet stack is detected by the sheet surface detection sensor 5. In this way, by lifting the sheet stacking tray 1 repeatedly in response to detection and non-detection of the sheet surface detection sensor 5, the upper surface of the sheet stack can always be maintained at a constant level. Incidentally, during the repeated lifting movements of the sheet stacking tray, if the sheet stacking tray 1 is detected by the upper limit detection sensor 4, it is judged as the sheet absence condition as mentioned above.

Next, means for feeding out the sheets stacked on the sheet stacking tray I will be explained. This means includes a pick-up roller (pick-up rotary member) 6 capable of contacting the upper surface of the sheet stack resting on the sheet stacking tray 1 to feed out the sheet, a roller drive motor 7 for rotatingly driving the pick-up roller 6, and a pick-up solenoid (second drive means) 8 for lifting and lowering the pick-up roller 6. The pick-up roller 6 is supported by a support member 9 for rocking movement and is biased downwardly by its own weight or a biasing means (not shown). When the pick-up solenoid 8 is turned ON, the pick-up roller is lifted.

A pair of separation rollers 10 includes a feed roller rotated in a sheet feeding direction and a separation roller rotated by a separation drive motor 11 in a direction opposite to the sheet feeding direction. If a plurality of sheets are fed out by the pick-up roller 6, the sheets are separated one by one between the rollers.

Now, the sheet supplying operation of the sheet supplying means will be explained. Incidentally, the tray drive motor 2, roller drive motor 7, pick-up solenoid 8 and separation drive motor 11 are appropriately controlled by a control means C.

When the sheet supplying operation is started, the pick-up solenoid 8 is turned ON to attract the support member 9 to thereby shift the pick-up roller 6 to an upper waiting position. In response to a sheet supply timing signal, the roller drive motor 7 is driven to rotate the pick-up roller 6, and then, the pick-up solenoid 8 is turned OFF to release the support member 9 to lower the pick-up roller 6. Consequently, the uppermost sheet in the sheet stack rested on the sheet stacking tray 1 is fed out by the pick-up roller 6.

The sheets fed out by the pick-up roller 6 are separated one by one by the pair of separation rollers 10, and the separated sheet is sent to an image forming portion through a convey path 12.

A post-separation sensor 14 is disposed immediately downstream of the pair of separation rollers 10 so that a tip end of the sheet separated by the pair of separation rollers 10 can be detected. In response to detection of the post-separation sensor 14, the pick-up solenoid 8 is turned ON to attract the support member 9 to thereby lift the pick-up roller 6 for waiting for a next sheet supplying operation. When the sheet is sent to the pair of separation rollers 10 in this way, by lifting the pick-up roller 6, the excessive pushing of the sheet into the pair of separation rollers 10 can be prevented and the urging force of the pick-up roller 6 to the sheet can be released, so that the stable sheet supply is achieved.

Next, the control of the sheet supplying timing effected by the control means C forming a part of the present invention will be explained. The control means C receives signals from the lower limit detection sensor 3, upper limit detection sensor 4 and sheet surface detection sensor 5 and serves to control the driving of the tray drive motor 2, roller drive motor 7, pick-up solenoid 8 and separation drive motor 11.

Figure 2:
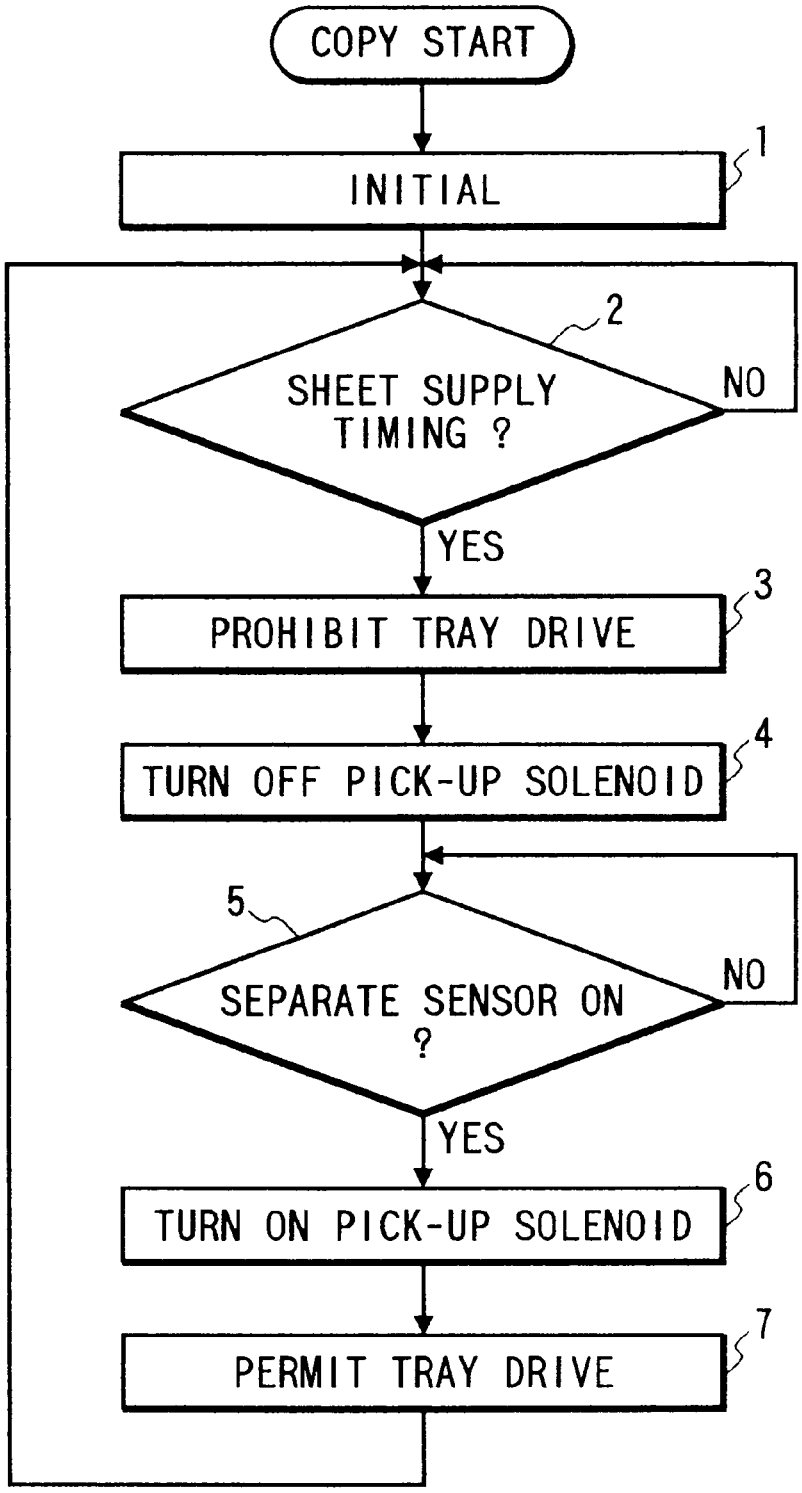
FIG. 2 is a flow chart for sheet supply control in the sheet supplying apparatus of FIG. 1.

The control method effected by the control means C will now be fully described with reference to a flow chart shown in FIG. 2.

After the cover (not shown) is opened to stack the sheets on the sheet stacking tray 1, when the cover is closed, the sheet stacking tray 1 is lifted by the tray drive motor 2. When the upper surface of the sheet stack rested on the sheet stacking tray 1 is detected by the sheet surface detection sensor 5, the tray drive motor 2 is stopped to permit the sheet supply.

When a copy start button (not shown) is depressed, a copy start sequence is started, and the sheet supply means is moved to "initial" (step 1). In the initial condition, the pair of separation rollers 10 start to be rotated by the separation drive motor 11, the pick-up solenoid 8 is turned ON to lift the pick-up roller 6, and the roller drive motor 7 is driven to rotate the pick-up roller 6.

After all of the initial settings are finished, a sheet supply start timing signal from the image forming portion is awaited (step 2). When the sheet supply start timing signal is inputted, the lifting movement of the sheet stacking tray 1 is prohibited (step 3). That is to say, before the sheet supply start timing signal is inputted, under the monitoring of the sheet surface detection sensor 5, if the upper surface of the sheet stack is not detected by the sheet surface detection sensor 5, the tray drive motor 2 is controlled so that the sheet stacking tray 1 is lifted until the sheet stack is detected by the sensor 5. On the other hand, after the sheet supply start timing signal is inputted, such control is prohibited, and, even if the upper surface of the sheet stack is not detected by the sheet surface detection sensor 5, the tray drive motor 2 is not driven to maintain the sheet stacking tray 1 at the position when the sheet supply start timing signal is inputted.

After the lifting and lowering movements of the sheet stacking tray 1 are prohibited, by turning OFF the pick-up solenoid 8 (step 4), the pick-up roller 6 is lowered to provide contact of the pick-up roller with the uppermost sheet in the sheet stack resting on the sheet stacking tray 1 to thereby start the sheet supply.

The fed sheets are separated one by one by the pair of separation rollers 10 to be sent to the convey path 12. Meanwhile, it is judged whether the tip end of the sheet is detected by the post-separation sensor 14 (step 5). When the tip end of the sheet is detected by the post-separation sensor 14, the pick-up solenoid 8 is turned ON (step 6) to separate the pick-up roller 6 from the upper surface of the sheet stack resting on the sheet stacking tray 1 to thereby permit the lifting movement of the sheet stacking tray 1 (step 7).

When the lifting movement of the sheet stacking tray 1 is permitted, the monitoring of the sensor 5 whether the upper surface of the sheet stack rested on the sheet stacking tray 1 is detected by the sheet surface detection sensor 5 is started again. If not detected, the tray drive motor 2 is driven to lift the sheet stacking tray 1 until the upper surface of the sheet stack rested on the sheet stacking tray 1 is detected by the sheet surface detection sensor 5. Meanwhile, the monitoring whether the sheet supply start timing signal is inputted or not is continued (step 2).

The operations from the step 2 to the step 7 are repeated until a predetermined number of sheets are supplied. When the sheet supply is completed, the copy start waiting condition is restored. If the upper surface of the sheet cannot be detected by the sheet surface detection sensor 5 and if the sheet stacking tray 1 is detected by the upper limit detection sensor 4 before the predetermined number of sheets are supplied, it is judged as the sheet absence condition of the sheet stacking tray 1 to cause the image forming apparatus to display "sheet absent". When the new sheets are replenished on the sheet stacking tray 1 a awaiting condition for waiting a new sheet supply start timing signal is established.

In this way, when the sheet is fed out by the pick-up roller 6, by prohibiting the lifting movement of the sheet stacking tray 1, the bounding of the pick-up roller 6 can be reduced. Thus, the rubbing and contamination of the pick-up roller and the sheet due to the impingement between them can be prevented, and the delay sheet jam due to the delay in the sheet supplying timing and the sheet jam due to the skew-feed of the sheet can be prevented, so that the stable sheet supply is achieved.

Next, another embodiment of the present invention will be explained with reference to FIG. 3 (sectional view) and FIG. 4 (flow chart). In this embodiment, in place of the pick-up solenoid 8 in the former embodiment, a stepping motor 20 is used. Incidentally, the control means C controls the stepping motor 20 in place of the pick-up solenoid 8.

Figure 3:
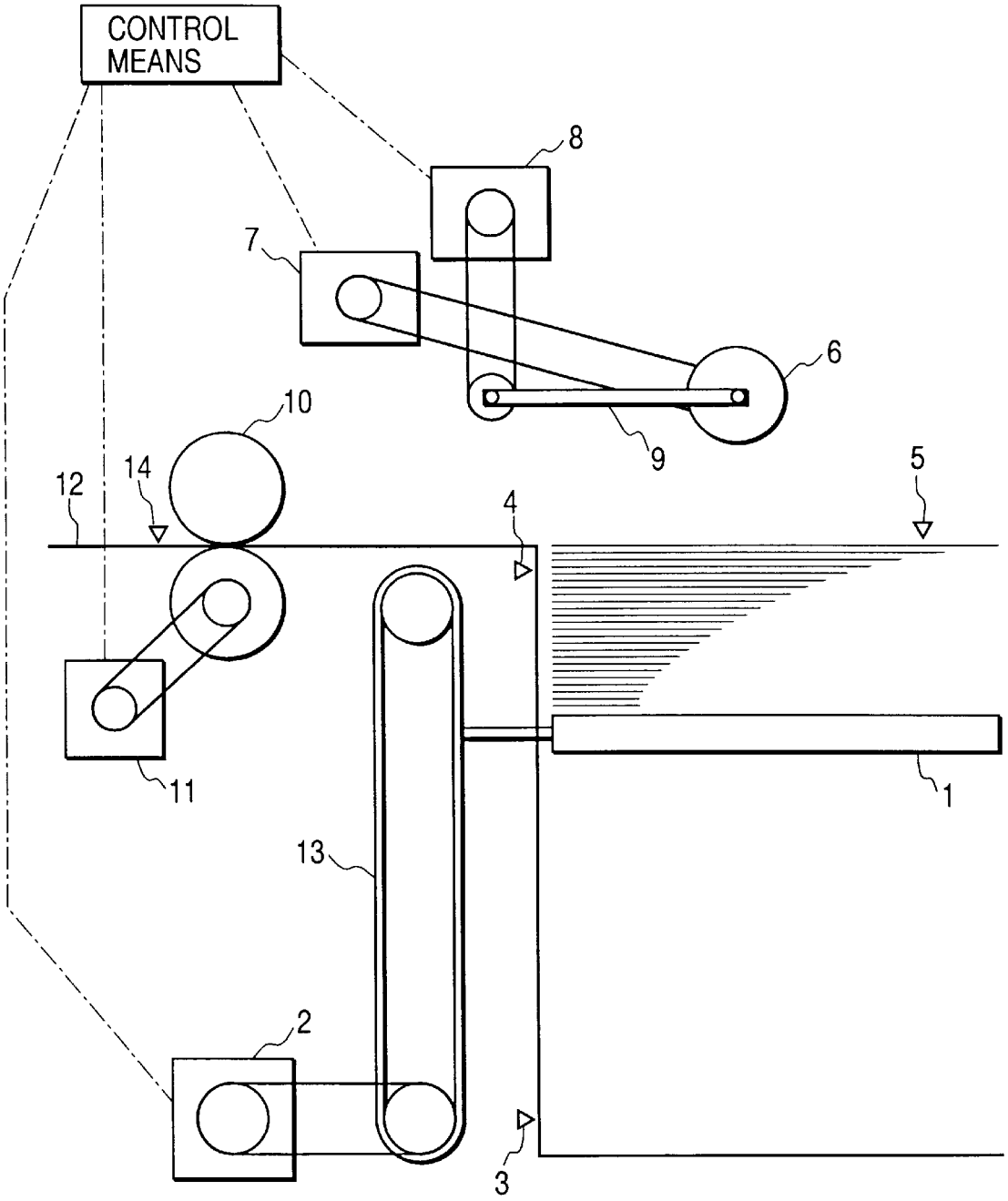
FIG. 3 is an elevational sectional view of a sheet supplying apparatus according to a second embodiment of the present invention.
Figure 4:
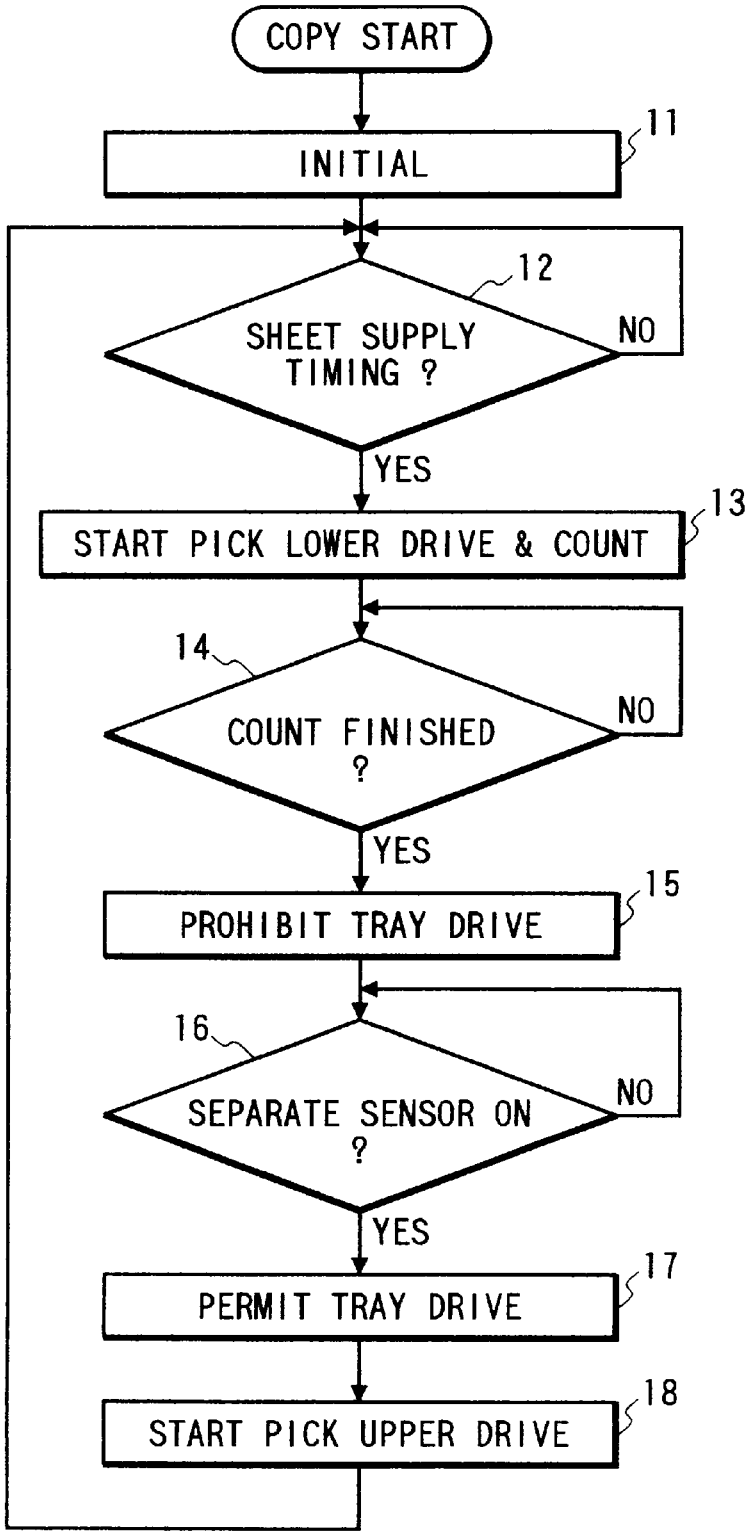
FIG. 4 is a flow chart for sheet supply control in the sheet supplying apparatus of FIG. 3.

As shown in FIG. 3, by rotating the support member 9 supporting the pick-up roller 6 by the stepping motor 20, the pick-up roller 6 is lifted and lowered. Since the other construction is the same as that of the former embodiment, detailed explanation thereof will be omitted.

The controlling method will be described with reference to FIG. 4. After the cover is opened to stack the sheets on the sheet stacking tray 1 in the lowered position, when the cover is closed, the sheet stacking tray 1 is lifted by the tray drive motor 2. When the upper surface of the sheet stack resting on the sheet stacking tray 1 is detected by the sheet surface detection sensor 5, the tray drive motor 2 is stopped to permit the sheet supply.

When the copy start button is depressed, a copy start sequence is started, and the sheet supply means is moved to "initial" (step 11). In the initial condition, the pair of separation rollers 10 start to be rotated by the separation drive motor 11, the stepping motor 20 is driven to lift the pick-up roller 6 via the support member 9, and the roller drive motor 7 is driven to rotate the pick-up roller 6 in the sheet supplying direction.

After all of the initial settings are finished, a sheet supply start timing signal from the image forming portion is awaited (step 12). When the sheet supply start timing signal is inputted, the stepping motor 20 is driven to lower the pick-up roller (lower drive). A pulse counter having the contents obtained by subtracting two pulses from a number of pulses required for actually contacting the pick-up roller 6 with the sheet starts to count the pulse number (step 13). In this case, the number of pulses for effecting the downward drive of the stepping motor 20 corresponds to the number of pulses required for actually contacting the pick-up roller 6 with the sheet.

Then, the count of the pulse number is started to judge whether the count is finished (step 14). If the count of the pulse number is finished, the lifting movement of the sheet stacking tray 1 is prohibited (step 15). That is to say, before the sheet supply start timing signal is inputted, if the upper surface of the sheet stack is not detected by the sheet surface detection sensor 5, the tray drive motor 2 is controlled so that the sheet stacking tray 1 is lifted until the sheet stack is detected by the sensor 5. On the other hand, after the sheet supply start timing signal is inputted, such control is prohibited, and, even if the upper surface of the sheet stack is not detected by the sheet surface detection sensor 5, the tray drive motor 2 is not driven to maintain the sheet stacking tray 1 at the position when the sheet supply start timing signal is inputted.

After the lifting movement of the sheet stacking tray 1 is prohibited, by effecting the downward drive of the stepping motor by the remaining number of pulses, the pick-up roller 6 is lowered via the support member 9 to contact the pick-up roller with the uppermost sheet in the sheet stack resting on the sheet stacking tray 1 to thereby start the sheet supply. After the stepping motor 20 is rotated by the number of pulses required for effecting the lower drive, the stepping motor is stopped.

The fed sheets are separated one by one by the pair of separation rollers 10, and the separated sheet is sent to the convey path 12. Meanwhile, it is judged whether the tip end of the sheet is detected by the post-separation sensor 14 (step 16). When the tip end of the sheet is detected by the post-separation sensor 14, the lifting movement of the sheet stacking tray 1 is permitted (step 17). When the lifting movement of the sheet stacking tray 1 is permitted, the monitoring of the sensor 5 whether the upper surface of the sheet stack rested on the sheet stacking tray 1 is detected by the sheet surface detection sensor 5 is started again. If not detected, the tray drive motor 2 is driven to lift the sheet stacking tray 1 until the upper surface of the sheet stack rested on the sheet stacking tray 1 is detected by the sheet surface detection sensor 5.

Then, upward drive of the stepping motor 20 is effected by the number of pulses require for effecting the upper drive (step 18) to lift the pick-up roller 6 via the support member 9 to thereby separate the pick-up roller 6 from the upper surface of the sheet stack rested on the sheet stacking tray 1. Meanwhile, the monitoring whether the sheet supply start timing signal is inputted or not is continued (step 12).

The operations from the step 12 to the step 18 are repeated until a predetermined number of sheets are supplied. When the sheet supply is completed, the copy start waiting condition is restored. If the upper surface of the sheet cannot be detected by the sheet surface detection sensor 5 and if the sheet stacking tray 1 is detected by the upper limit detection sensor 4 before the predetermined number of sheets are supplied, it is judged as the sheet absence condition of the sheet stacking tray 1 to cause the image forming apparatus to display "sheet absent". It is awaiting that new sheets are replenished on the sheet stacking tray 1. When the new sheets are replenished, a waiting condition for awaiting a new sheet supply start timing signal is established (step 12).

In place of the above-mentioned embodiments, a time period required for the motor to lift or lower the pick-up roller 6 may be previously measured or calculated, and the movement of the sheet stacking tray 1 may be prohibited only during certain time periods before and after the pick-up roller 6 actually contacts with the upper surface of the sheet stack rested on the sheet stacking tray 1.

Also in this embodiment, the bounding of the pick-up roller 6 due to the impingement between the pick-up roller and the sheet can be prevented to avoid the damage of the pick-up roller and the sheet, and, the delay sheet jam due to the delay in the sheet supplying timing can be prevented.

Figure 5:
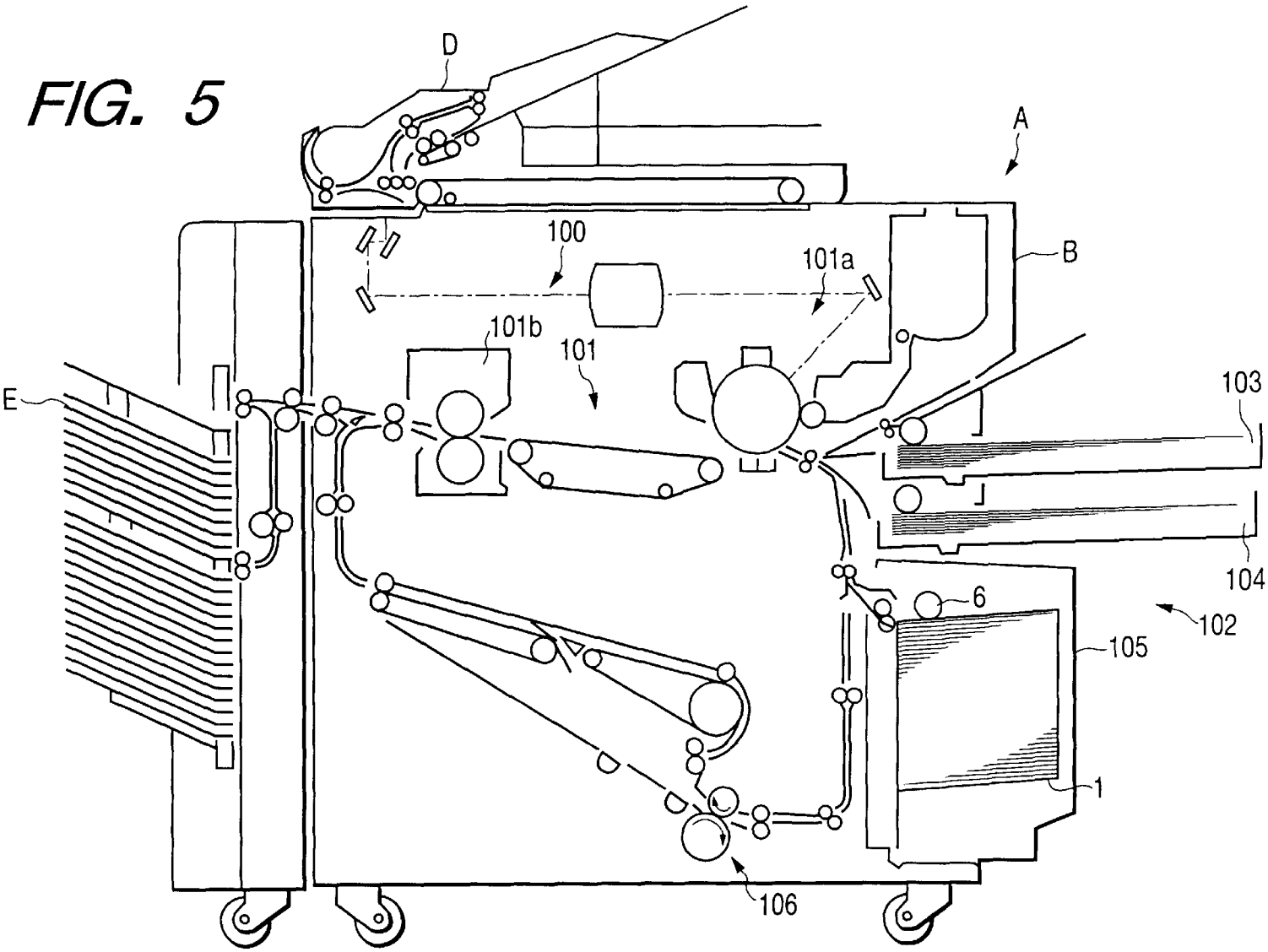
FIG. 5 is a sectional view showing an example of an image forming apparatus having the sheet supplying apparatus according to the present invention.

Next, an example of an image forming apparatus (copying machine) utilizing the sheet supplying apparatus having the above-mentioned construction will be explained with reference to FIG. 5.

The copying machine A includes an image forming device B for forming an image on the sheet, an automatic original feeding device (automatic document feeder) D capable of continuously supplying originals to a reading portion of the image forming device automatically, and a sorter E for receiving the sheets on which the images were formed and which are discharged from the image forming device.

The image forming device B includes a reading portion 100 for reading an image on the original, an image forming portion 101 for forming the read image on the sheet, and a sheet supply portion 102 for supplying the sheet to the image forming portion 101. The sheet supply portion 102 includes cassettes 103, 104 which can be detachably mounted to the image forming device B and a deck 105 capable of containing a large number of sheets.

The image forming portion 101 comprises a transfer portion 101*a* including a photosensitive member, a developing device, a transfer charger, a separation charger, a cleaner and a first charger, and a fixing portion 101*b* for fixing a toner image transferred onto the sheet in the transfer portion to the sheet. Below the image forming portion 101, there is disposed a re-convey means 106 for re-conveying the sheet for multi copy or both-face copy.

With the arrangement as mentioned above, the image read from the original is transferred and fixed to the sheet fed from the cassette 103 or 104 or the deck 105 at the image forming portion, and then is discharged directly to the sorter E or conveyed to the re-convey means 106 for the next image formation.

Incidentally, the present invention is applicable to the deck 105 and the automatic original feeding device D of this copying machine.

What is claimed is:

1. A sheet supplying apparatus comprising:

sheet stacking means which can be lifted and lowered with stacked sheets thereon;

first drive means for lifting said sheet stacking means so that an uppermost surface of the sheets stacked on said sheet stacking means is maintained at a predetermined position;

a pick-up rotary member, which can be lifted and lowered, for feeding out an uppermost sheet of the sheets stacked on said sheet stacking means when said pick-up rotary member is lowered and contacted with the uppermost surface of the sheets stacked on said sheet stacking means;

second drive means for lowering said pick-up rotary member to be contacted with the uppermost surface of the sheets on said sheet stacking means; and control means for prohibiting a lifting operation of said sheet stacking means by said first drive means before said pick-up rotary member which is lowered by said second drive means is contacted with the uppermost surface of the sheets stacked on said sheet stacking means.

2. A sheet supplying apparatus according to claim 1, wherein said sheet stacking means is lifted and lowered while maintaining a horizontal condition and while supporting the sheets.

3. A sheet supplying apparatus according to claim 1, wherein said control means prohibits an operation of said first drive means when a sheet supply timing signal is inputted.

4. A sheet supplying apparatus according to claim 1, wherein said second drive means includes a pulse motor, and said control means prohibits an operation of said first drive means when the number of pulses smaller than the number of pulses required for driving said pulse motor to lower said pick-up rotary member so that said pick-up rotary member contacts with the sheet is counted.

5. A sheet supplying apparatus according to claim 1, wherein said control means prohibits an operation of said first drive means when said pick-up rotary member is lowered by said second drive means, and permits the operation of said first drive means when said pick-up rotary member is lifted.

6. A sheet supplying apparatus according to claim 5, further comprising a separation means for separating the sheets supplied by said pick-up rotary member one by one, and a post-separation sensor disposed downstream of said separation means, wherein said second drive means is driven on the basis of detection of said post-separation sensor to lift said pick-up rotary member.

7. A sheet supplying apparatus according to any one of claims 1 or 3 through 6, further comprising a sheet surface detection sensor capable of detecting the uppermost surface of the sheets stacked on said sheet stacking means, wherein said first drive means is driven on the basis of detection of said sheet surface detection means to maintain the uppermost surface of the sheets stacked on said sheet stacking means in a predetermined level.

8. An image forming apparatus comprising:

sheet stacking means which can be lifted and lowered with stacked sheets thereon;

first drive means for lifting said sheet stacking means so that an uppermost surface of the sheets stacked on said sheet stacking means is maintained at a predetermined position;

a pick-up rotary member which can be lifted and lowered, for feeding out an uppermost sheet of the sheets stacked on said sheet stacking means when said pick-up rotary member is lowered and contacted with the uppermost surface of the sheets stacked on said sheet stacking means;

second drive means for lowering said pick-up rotary member to be contacted with the uppermost surface of the sheets on said sheet stacking means;

control means for prohibiting a lift operation of said sheet stacking means by said first drive means before said pick-up rotary member which is lowered by said second drive means is contacted with the uppermost surface of the sheets stacked on said sheet stacking means; and treating means for effecting predetermined treatment regarding the sheet fed by said pick-up rotary member.

* * * * *

UNITED STATES PATENT AND TRADEMARK OFFICE

CERTIFICATE OF CORRECTION

PATENT NO. : 5,988,628

DATED : November 23, 1999

INVENTOR(S): AKIHITO MORI

It is certified that error appears in the above-identified patent and that said Letters Patent is hereby corrected as shown below:

COLUMN 1:
Line 64, "arising" should read --giving rise to--.

COLUMN 6:
Line 9, "waiting" should read --awaiting--.

Signed and Sealed this

Third Day of April, 2001

Nicholas P. Godici

*Attest:*

NICHOLAS P. GODICI

*Attesting Officer*

*Acting Director of the United States Patent and Trademark Office*